US006592421B1

(12) United States Patent
Clever

(10) Patent No.: US 6,592,421 B1
(45) Date of Patent: Jul. 15, 2003

(54) TOTIPOTENT HUB FOR CONSTRUCTION TOY SYSTEM

(76) Inventor: Eric Clever, 29 Estaugh Ave., Haddonfield, NJ (US) 08033

( * ) Notice: Subject to any disclaimer, the term of this patent is extended or adjusted under 35 U.S.C. 154(b) by 0 days.

(21) Appl. No.: 10/201,461

(22) Filed: Jul. 23, 2002

Related U.S. Application Data

(63) Continuation-in-part of application No. 09/855,265, filed on May 15, 2001, now Pat. No. 6,422,909, which is a continuation of application No. 09/359,204, filed on Jul. 22, 1999, now Pat. No. 6,231,416, which is a continuation of application No. 08/862,948, filed on May 30, 1997, now abandoned.

(60) Provisional application No. 60/018,771, filed on May 31, 1996.

(51) Int. Cl.[7] ..... A63H 33/08

(52) U.S. Cl. ..... 446/108; 446/120; 446/124

(58) Field of Search ..... 446/107, 108, 446/109, 111, 112, 113, 114, 120, 124, 125, 127

(56) References Cited

U.S. PATENT DOCUMENTS

| | | | | |
|---|---|---|---|---|
| 1,113,371 A | | 10/1914 | Pajeau | |
| 2,633,662 A | | 4/1953 | Nelson | |
| 2,984,935 A | | 5/1961 | Beck | |
| 4,758,196 A | | 7/1988 | Wang | |
| D304,217 S | | 10/1989 | Klitsner | |
| 4,902,259 A | | 2/1990 | Ziegler | |
| 5,049,105 A | | 9/1991 | Glickman | |
| 5,061,219 A | | 10/1991 | Glickman | |
| 5,183,409 A | | 2/1993 | Clever et al. | |
| 5,322,467 A | | 6/1994 | Barzani | |
| 5,769,681 A | | 6/1998 | Greenwood et al. | |
| 5,904,606 A | * | 5/1999 | Zimmer et al. | 446/108 |
| 6,149,487 A | * | 11/2000 | Peng | 446/114 |
| 6,231,416 B1 | | 5/2001 | Clever et al. | |
| 6,325,694 B1 | | 12/2001 | Clever et al. | |

* cited by examiner

*Primary Examiner*—Jacob K. Ackun
(74) *Attorney, Agent, or Firm*—Norman E. Lehrer

(57) ABSTRACT

Disclosed are improvements to a construction system based on genderless connectors. The improvements include a totipotent hub that by itself can accomplish the three basic requirements of a hub-and-rod construction system: construct a one-one-square-root-of-two right triangle, construct a logarithmic spiral based on same, and tile the plan with triangles. Other inventions are disclosed including a genderless two-piece rivet system.

2 Claims, 17 Drawing Sheets

FIG 4

Table 1: (length relationships in the logarithmic-spiral triangles)

| <-- Leg --> | | < --Hyp --> | | Log Triangle |
|---|---|---|---|---|
| $\alpha$ | $\beta$ | $\alpha$ | $\beta$ | Ln |
| 2 | 0 | 1 | 1 | L1 |
| 1 | 1 | 4 | 0 | L2 |
| 4 | 0 | 2 | 2 | L3 |
| 2 | 2 | 8 | 0 | L4 |
| 8 | 0 | 4 | 4 | L5 |
| 4 | 4 | 16 | 0 | L6 |
| .. | .. | .. | .. | .. |

Table 2: (length relationships in the plane-tiling triangles)

| | | | | Tiling Triangle |
|---|---|---|---|---|
| $\alpha$ | $\beta$ | $\alpha$ | $\beta$ | Tn |
| 2 | - | 1 | 1 | T1 |
| 4 | - | 2 | 2 | T2 |
| 6 | - | 3 | 3 | T3 |
| 8 | - | 4 | 4 | T4 |
| .. | - | .. | .. | .. |
| 2n | - | n | n | Tn |

91
92
97a
97b
97c
93

91
94a
94b
94c
94d
95a
95b
95c
95d
92
93
97a
97b
97c 91
202
203
204
95a
95b
95c
95d
96
97a
97b
97c
93
98
99
92
1/2α
α

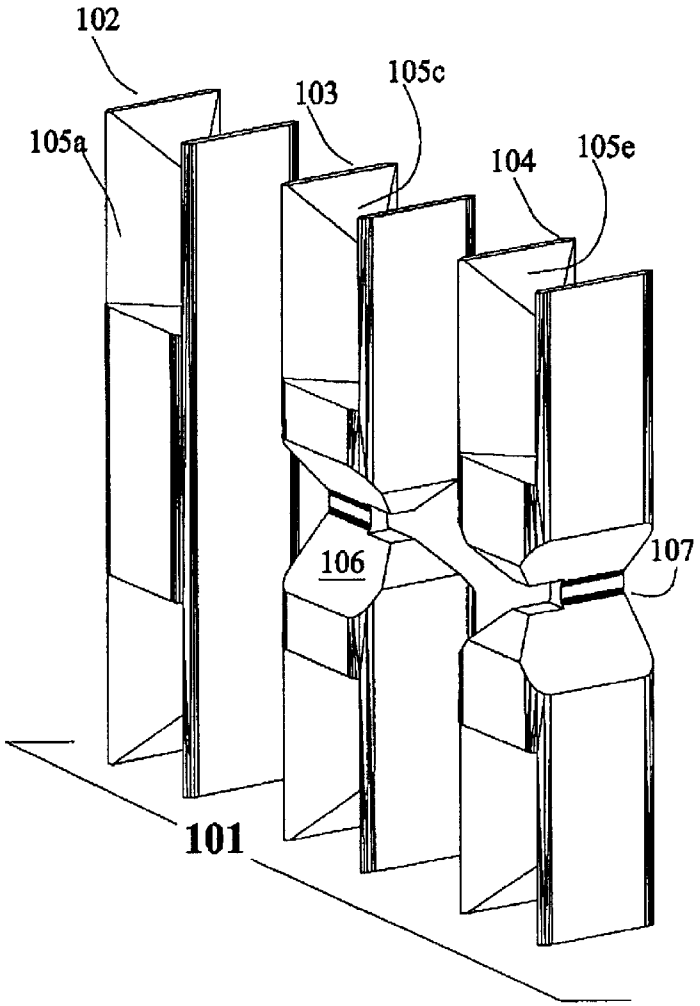
FIG 10
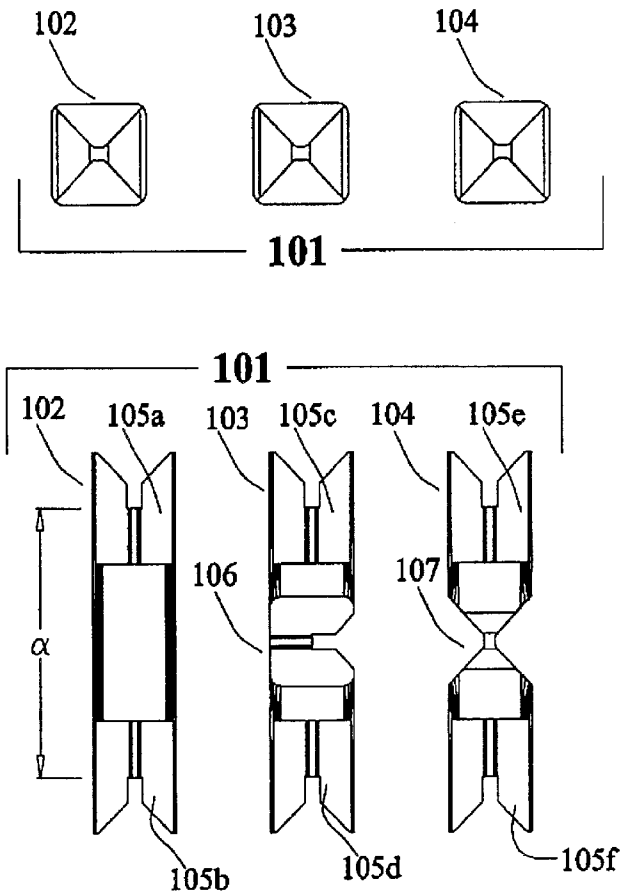

114
110
112
116
111
113

111
113
115
112
116
110

114
110
112

110
111
113

130
131a
131b
133
134
132

133
130

137
135
136

130
132
133

188
184a
189a
189b
189c
189d
184b
181
184c
180
187
222a
182a
183a
183b
182b
222b 182a
184
182b 185
186

184a
188
181
180
187
222a
182a
182b
222b

TOTIPOTENT HUB FOR CONSTRUCTION TOY SYSTEM

CROSS-REFERENCE TO RELATED APPLICATIONS

This application is a continuation-in-part of prior application Ser. No. 09/855,265, filed May 15, 2001, now U.S. Pat. No. 6,422,909, which was a continuation of application Ser. No. 09/359,204, filed Jul. 22, 1999, now U.S. Pat. No. 6,231,416, which was a continuation of application Ser. No. 08/862,948, filed May 30, 1997, now abandoned and which claimed the benefit of provisional patent application Serial No. 60/018,771, filed May 31, 1996.

BACKGROUND OF THE INVENTION

This invention relates to construction toy systems. More particularly, it relates to both hub and rod construction toy systems based on hermaphroditic and identical (genderless) connectors, and to building block systems also based on genderless connectors. In many cases the genderless connectors are integral to the parts being connected. And the genderless connectors greatly extend the range of applications for this invention.

This is a crowded art with much activity in the construction toy system part of it, with many U.S. patents, referred to by number below, known to the inventor that have some pertinence. U.S. Pat. No. 1,113,371 discloses the original rod and hub construction toy system with wooden hubs and rods and with the rod inserted into a hole in the hub and held there by friction and compression (interference fit). U.S. Pat. No. 1,707,691 discloses a hub and rod construction toy system with a hub of stamped metal and wooden rods with slit ends. The connection is formed by inserting the metal hub into the rod-end slit.

A great many construction toy systems allow identical elements to be interconnected but with only a few exceptions noted below the actual connections are not genderless. Instead, the male and female connecting elements are placed on opposite ends of the block or hub. In any event, we found no construction system that allowed genderless connection between non-identical elements, e.g., between hub and rod. U.S. Pat. No. 3,626,632 discloses a typical building block system that allows identical blocks to be interconnected by means of a male element on one side and female elements on three other sides. But U.S. Pat. No. 2,800,743 discloses a nearly genderless building block system. But in this system when genderless connections are made the elements are no longer aligned and regular figures can not be constructed.

U.S. Pat. No. 2,633,662 discloses a construction toy system with genderless interconnection for hubs connected orthogonally. But hub and rod connections in the same plane are effected with rods that connect across the face of the hubs and do not form a genderless connection. U.S. Pat. No. 4,758,196 discloses a hub and rod construction toy system with genderless rod-rod connections but without any way of directly connecting the hubs.

Various concepts from the construction and other industries have been adapted to construction toy systems. U.S. Pat. No. 3,648,404 discloses a hub and rod construction system designed to be used with hollow rods. The construction toy system disclosed in U.S. Pat. Nos. 4,078,328 and 5,049,105 uses a similar connection system. U.S. Pat. No. 3,891,335 discloses a hub and rod and panel snap together construction system. The hub and rod construction toy system disclosed in U.S. Pat. Nos. 5,061,219, 5,137,486 and 5,199,919 uses a retaining clip similar to the one disclosed in the '335 patent. The '486 patent does disclose a genderless hub-hub connection for orthogonally connecting hubs. However, the means of connecting the hubs is not the same means as connecting rods to hubs.

Other mechanical connectors include U.S. Pat. No. 4,280,339, which discloses a torque transfer device for flexible shaft couplings. Each shaft has an extended portion with forked ends defining teeth. The teeth are inserted orthogonally to each other. U.S. Pat. No. 3,800,556 discloses a power shaft coupling including a coupling mechanism having elongate square bars defining extensions. These extensions may be mutually inserted in orthogonal positional relationship. U.S. Pat. No. 2,577,508 is a universal coupling with bifurcated tongues that mate. U.S. Pat. No. 2,832,943 is a detachable coupling in which the male and female members are not identical but do have an orthogonal insert relationship. U.S. Pat. No. 3,224,222 is a universal joint with yoke members including cross-pintles for connecting the yoke members together.

Hermaphroditic connectors have been used in the electronic connector industry. The invention disclosed herein grew out of our prior electronic connector inventions as shown in U.S. Pat. No. No. 5,183,409 and in our continuation in part application filed on Aug. 01, 1994.

Other presently known U.S. patents of interest are: U.S. Pat. Nos. 3,516,043; 3,070,769; 2,690,542; 3,011,143; 4,199,208; 3,634,811; 2,996,026; 3,070,769; 2,475,046; 2,470,282; 1,865,300; 2,577,508; 607,607; 3,552,145; 1,171,380; 2,740,271; 4,172,369; 2,460,231; 534,732, and 2,389,115. It is believed that the present invention is patentably distinct from the teachings of any of the above-cited Patents.

SUMMARY OF THE INVENTION

Disclosed is an improvement to the construction toy systems disclosed in our prior applications referred to above all of which that describe toy systems all of whose parts directly interconnect by means of genderless connectors. These new inventions include a square hub, which by itself can fulfill the role of the three basic components of the inventions disclosed in our prior U.S. Pat. No. 6,231,416—hub, short rod and long rod (the basic components of a hub-and-rod construction system). Said new invention augments our prior inventions but also can be completely independent of them because by itself it can be used to construct the standard logarithmic spiral that is the test of the correctness and usefulness of a hub and rod system. And as can be seen in the illustrations, it can be used to construct rectangular walls—a feat that no basic hub and rod system can accomplish. Also disclosed are: a new beam-and-beam construction system also based on genderless connectors similar to connectors disclosed in our previous patents and swivel connectors similar to those that we have previously disclosed. Genderless demi-rivets are also disclosed that, when connected together, form a rivet.

By the use of these genderless connectors plus the disclosed improvements, a very wide range of very different and independent toy systems can be designed that freely inter-connect. In fact, the invention disclosed in the related application with the addition of the improvements disclosed in this application allows for the creation of a near universal construction toy system—one that allows for free interconnection across a wide range of construction toy types: hub-and-rod, beam-and-beam, blocks, and geodesics all in a range of sizes that makes them appropriate for various age groups from toddler (very large and easy to grasp) to adult (miniature, precision) with all the pieces from all the sizes and types interconnecting.

BRIEF DESCRIPTION OF THE FIGURES

For the purpose of illustrating the invention, there is shown in the accompanying drawings forms which are presently preferred; it being understood that the invention is not intended to be limited to the precise arrangements and instrumentalities shown.

FIG. 4 shows tables illustrating dimensional relationships of the parts of the hubs of FIG. 2;

FIG. 10 shows in plan, end, and perspective views three additional α-length beams—C, D and E: C being a simple beam and D and E are used to make T-joints. In D all three connectors are in the same plane while in E they are not;

DESCRIPTION OF THE PREFERRED EMBODIMENTS

Totipotent hubs disclosed herein extend the hub-and-rod systems of our U.S. Pat. No. 6,231,416. Said system was already notable in that, unlike all other hub-and-rod systems it only required three parts to perform the two basic functions of a hub-and-rod system: tile the plane and construct a logarithmic spiral. A totipotent hub of the invention is even more remarkable in that identical hubs can be assembled into those same structures without the use of any other parts (which is why they are totipotent).

Figure 1B:
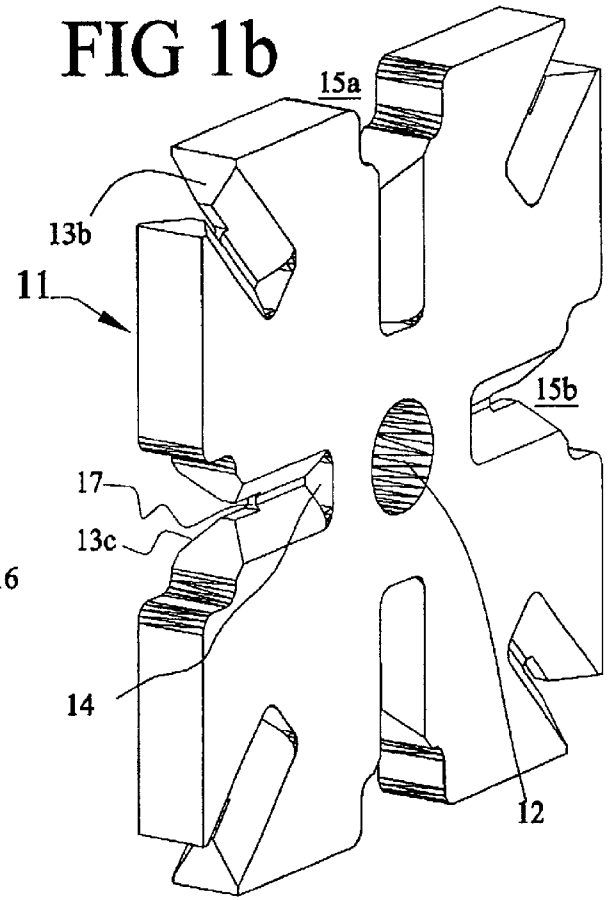
FIGS. 1*a*, 1*b*, and 1*c* show a totipotent hub in plan and perspective views.
Figure 1C:
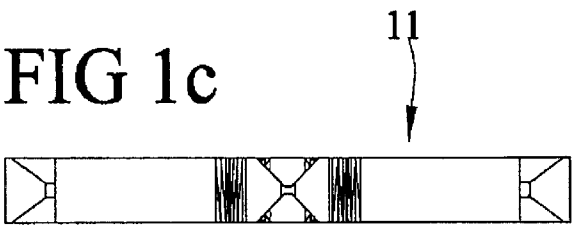
Figure 1A:
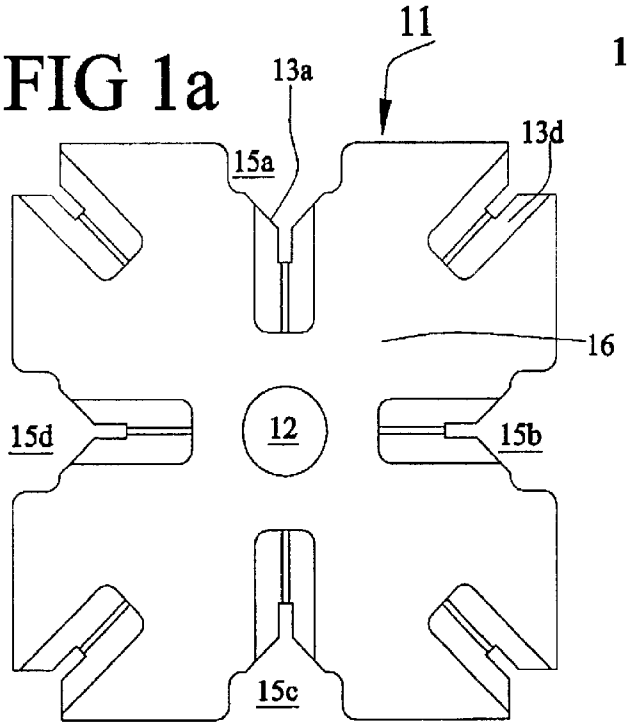
Figure 2:
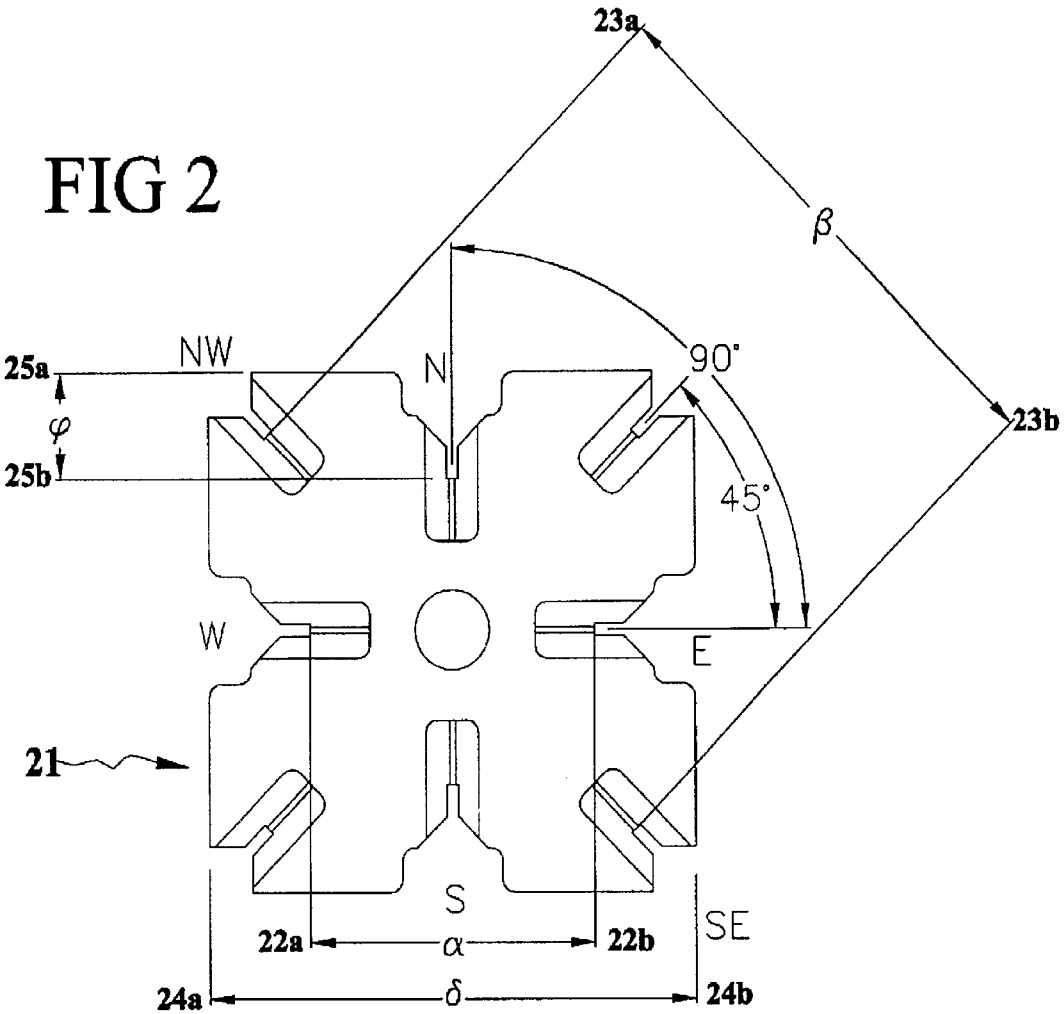
FIG. 2 shows a totipotent hub in plan view with absolute and relative dimensions furnished for clarity of exposition.

Another way of thinking about this is that totipotent hubs extend the hubs of the '416 patent. The '416 hubs are in themselves remarkable—unlike other hub-and-rod systems, the '416 hubs could be used by themselves in large constructions—in particular spheroids can be constructed of identical hubs. As can be seen in FIG. 1, said hub is square and furnished with four diagonally situated connectors (one at each corner) and four orthogonally situated connectors (one at each pole—the NSEW connectors). The distance between two opposite NSEW connectors as shown in FIG. 2 is 'α' and the distance between two opposite diagonally situated connectors as shown in FIG. 2 is 'β'. In order to use said hubs as totipotent hubs for a hub-and-rod construction system, then the distance β must satisfy the following equation:

$$\beta=\alpha((2\sqrt{2})-1)$$

or $$\beta\approx 1.828\alpha$$

which here we accomplish by slightly recessing the NSEW connectors. We could just as easily protrude the diagonally situated connectors. As drawn, said hub's material thickness is approximately 10% its maximum orthogonal diameter 'δ'.

TABLE 1

(length relationships in the logarithmic-spiral triangles)

| <-- Leg --> | | <--Hyp --> | | Log | Triangle |
|---|---|---|---|---|---|
| a | b | a | b | Ln | |
| 2 | 0 | 1 | 1 | L1 | (T1) |
| 1 | 1 | 4 | 0 | L2 | |
| 4 | 0 | 2 | 2 | L3 | (T2) |
| 2 | 2 | 8 | 0 | L4 | |
| 8 | 0 | 4 | 4 | L5 | (T4) |
| 4 | 4 | 16 | 0 | L6 | |
| 16 | 0 | 8 | 8 | L7 | (T8) |
| . . . | . . . | . . . | . . . | . . . | |

TABLE 2

(length relationships in the plane-tiling triangles)

| <-- Leg --> | | <--Hyp --> | | Tiling | Triangle |
|---|---|---|---|---|---|
| a | b | a | b | Tn | |
| 2 | — | 1 | 1 | T1 | |
| 4 | — | 2 | 2 | T2 | |
| 6 | — | 3 | 3 | T3 | |

TABLE 2-continued (length relationships in the plane-tiling triangles)

| <-- Leg --> | | <--Hyp --> | | Tiling | Triangle |
|---|---|---|---|---|---|
| 8 | — | 4 | 4 | T4 | |
| . . . | — | . . . | . . . | . . . | |
| 2n | — | n | n | Tn | |

Figures 3A, 3B, 3C:
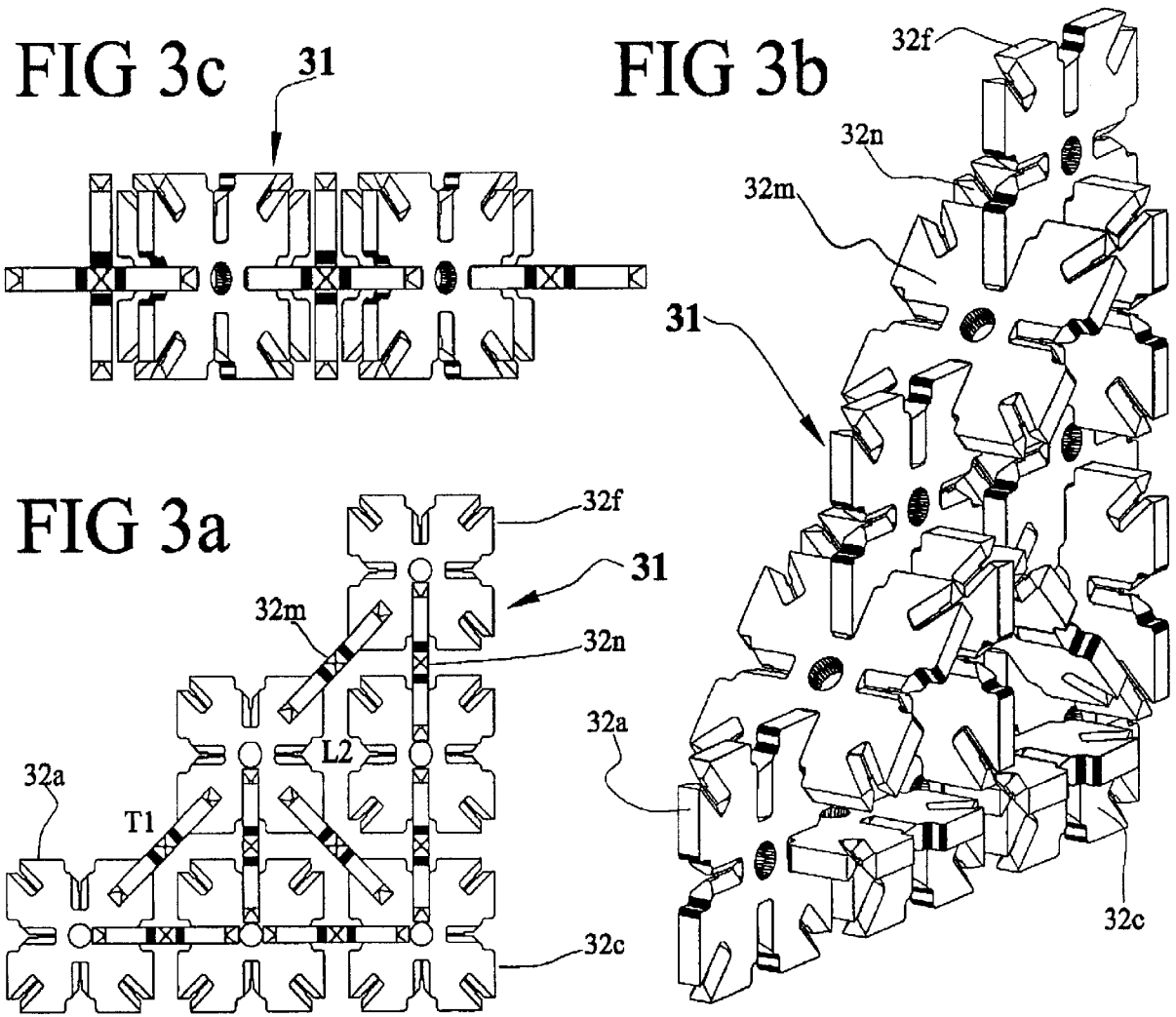
FIGS. 3*a*, 3*b*, and 3*c* show an assembly of identical totipotent hubs in plan and perspective views in a plane-tiling configuration.
Figure 5B:
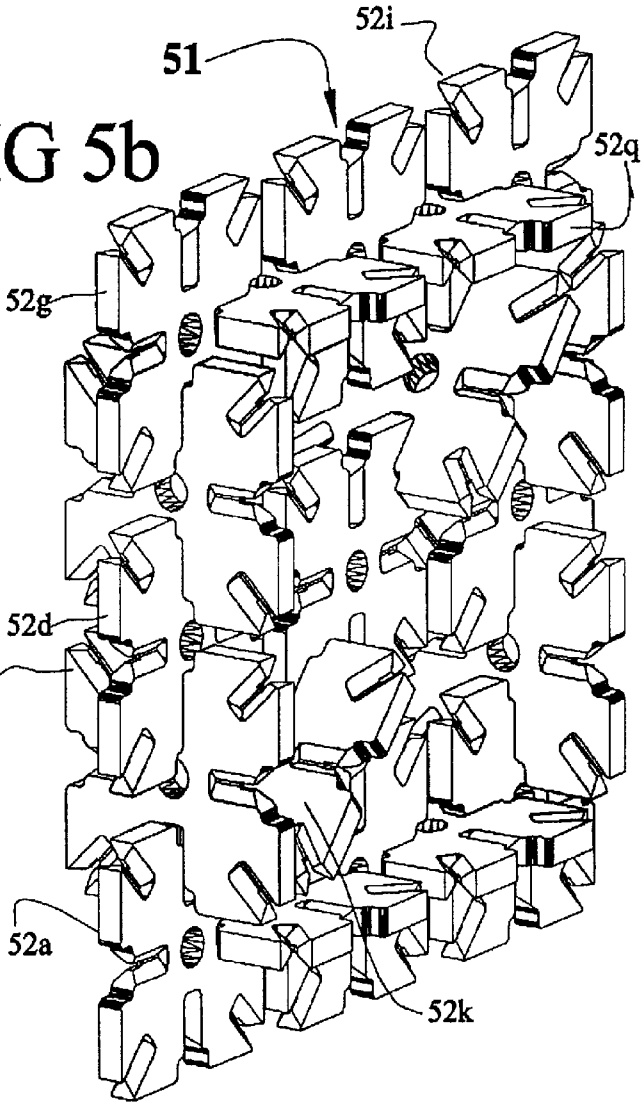
FIGS. 5*a* and 5*b* show identical totipotent hubs in a plane-tiling configuration assembled into a rectangle in both plane and perspective views.
Figure 5A:
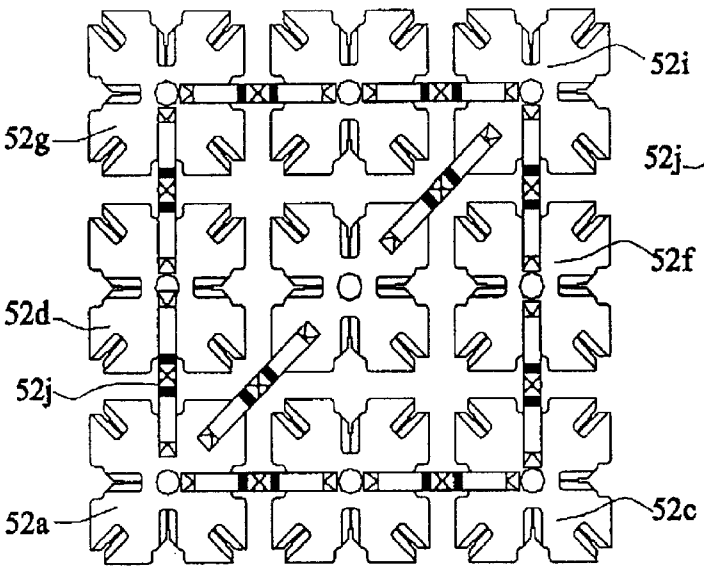

In FIG. 3 we can see that in fact one can tile a plane with identical hubs the invention. The mathematics of which is elucidated in Table 2 of FIG. 4. In FIG. 6 we see that one can also construct a logarithmic spiral with identical hubs of the invention. The mathematics of which is elucidated in Table 1 of FIG. 4. FIG. 5 shows a rectangular plane tiling. FIG. 7 shows a totipotent hub similar to hub 11 except that none of its genderless connectors have backstops. Such a condition facilitates connection with other hubs and rods of radically different sizes.

DESCRIPTION OF THE RELATED EMBODIMENTS

Beam-and-beam systems shown in FIGS. 9 to 13 extend the hub-and-rod systems of the '416 patent and related applications to frame-based construction systems. If such a system contains: α-spaced, α-length, β-spaced, β-length beams and multiple and sub multiples of same, then the rules of Tables 1 and 2 hold for the system. Such a result guarantees that it can make use of the rich possibilities of '1-1√2 right triangles'. A demi-rivet 130 disclosed below is itself a notable improvement with applications far outside beam-and-beam systems for which it was conceived.

Also shown in FIG. 14 is ½ of an adjustable length rod(/beam) pair. When two such are correctly mated they form an adjustable length rod(/beam). The mating surfaces on the adjustable length portion are rough—similar to the 'one-way' grooves on the demi-rivets but not as extreme.

Figure 15:
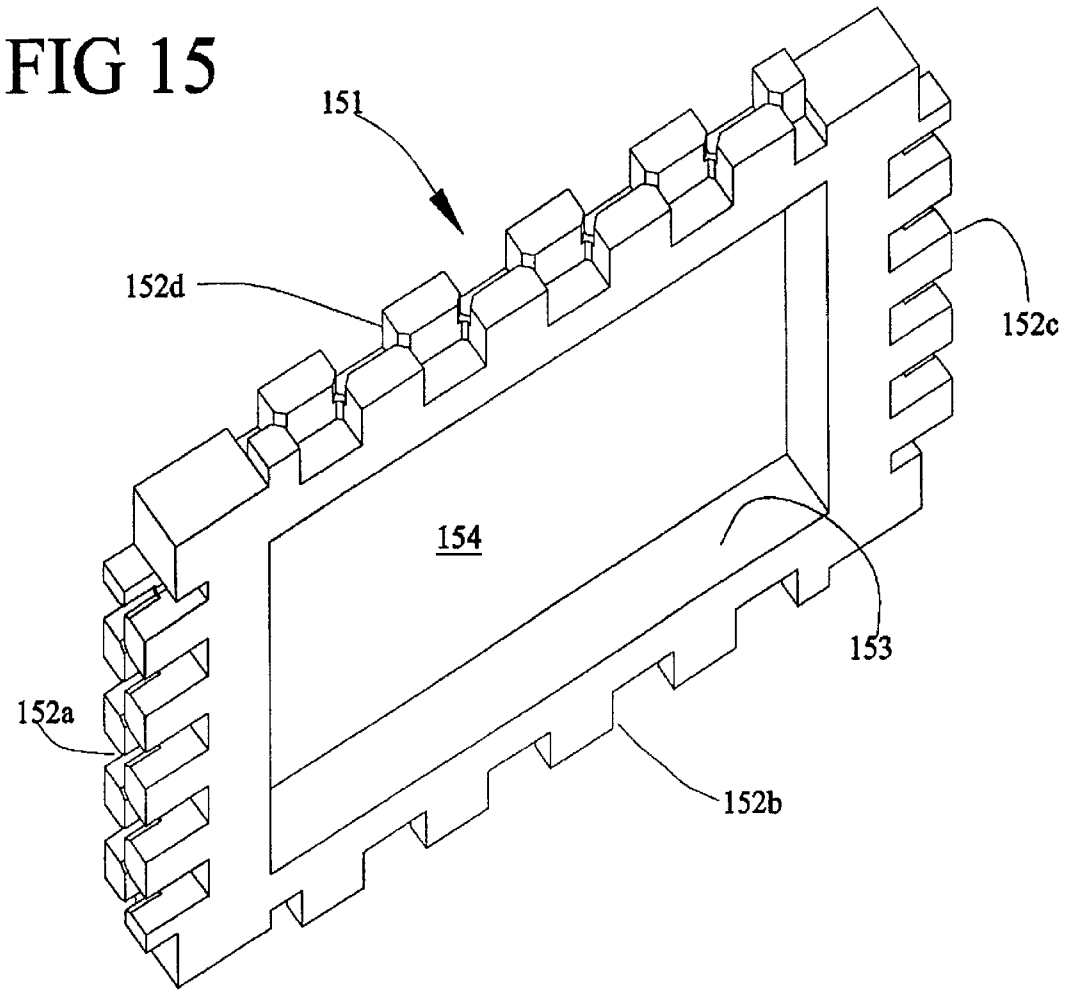
FIG. 15 shows in perspective view a (hollow) square panel; its four edges being furnished with identical genderless connectors. Such a panel can be inserted into an array of panels without regard to top, bottom, left, right, back or front.
Figure 16:
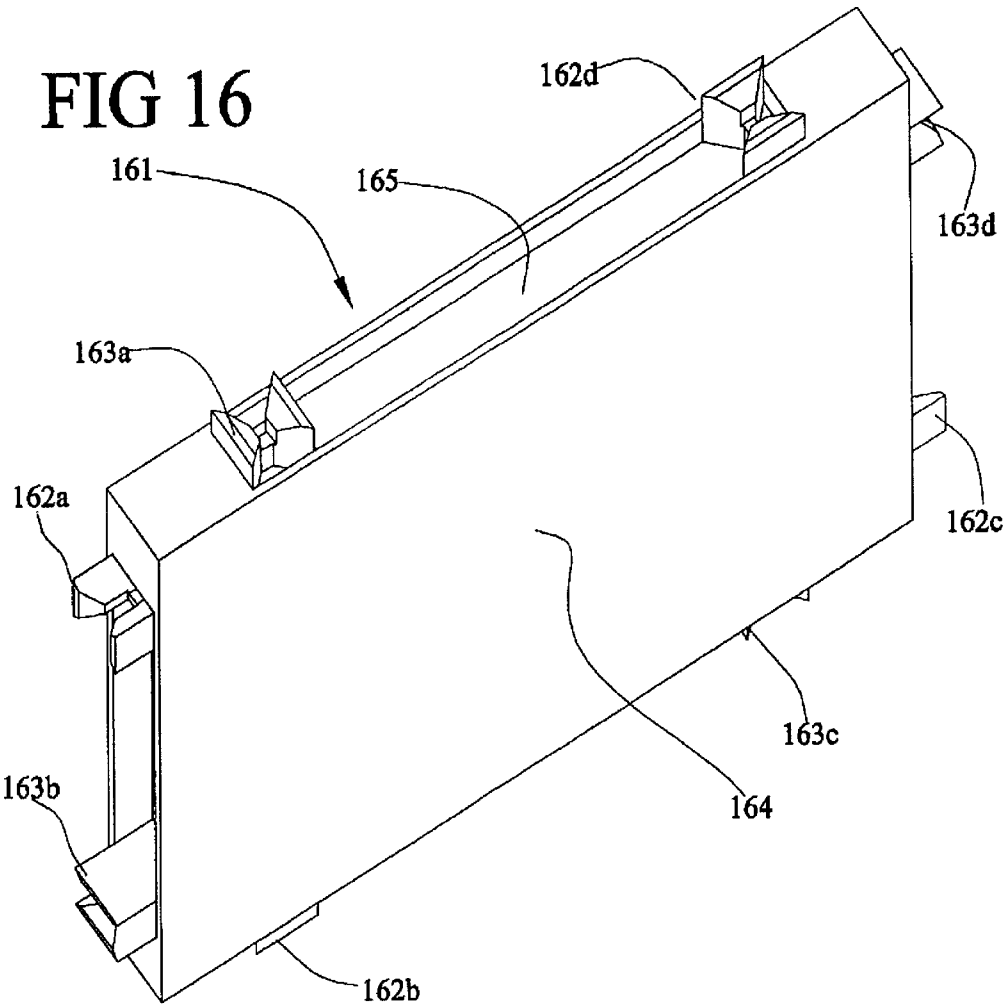
FIG. 16 shows in perspective view a panel similar to the panel of FIG. 15 except that it will freely mate with all of the rods and beams of the related patents and applications. However, it has fewer degrees of freedom and it has a distinguishable front and back.

FIGS. 15 and 16 show panels that can be used to construct walls. Genderless connectors on the panel in FIG. 16 are identical to the connectors of the beam system disclosed herein and can freely mate with them (and most of the rods of the related patents and applications) thereby extending both systems.

Figures 17A, 17B, 17C:
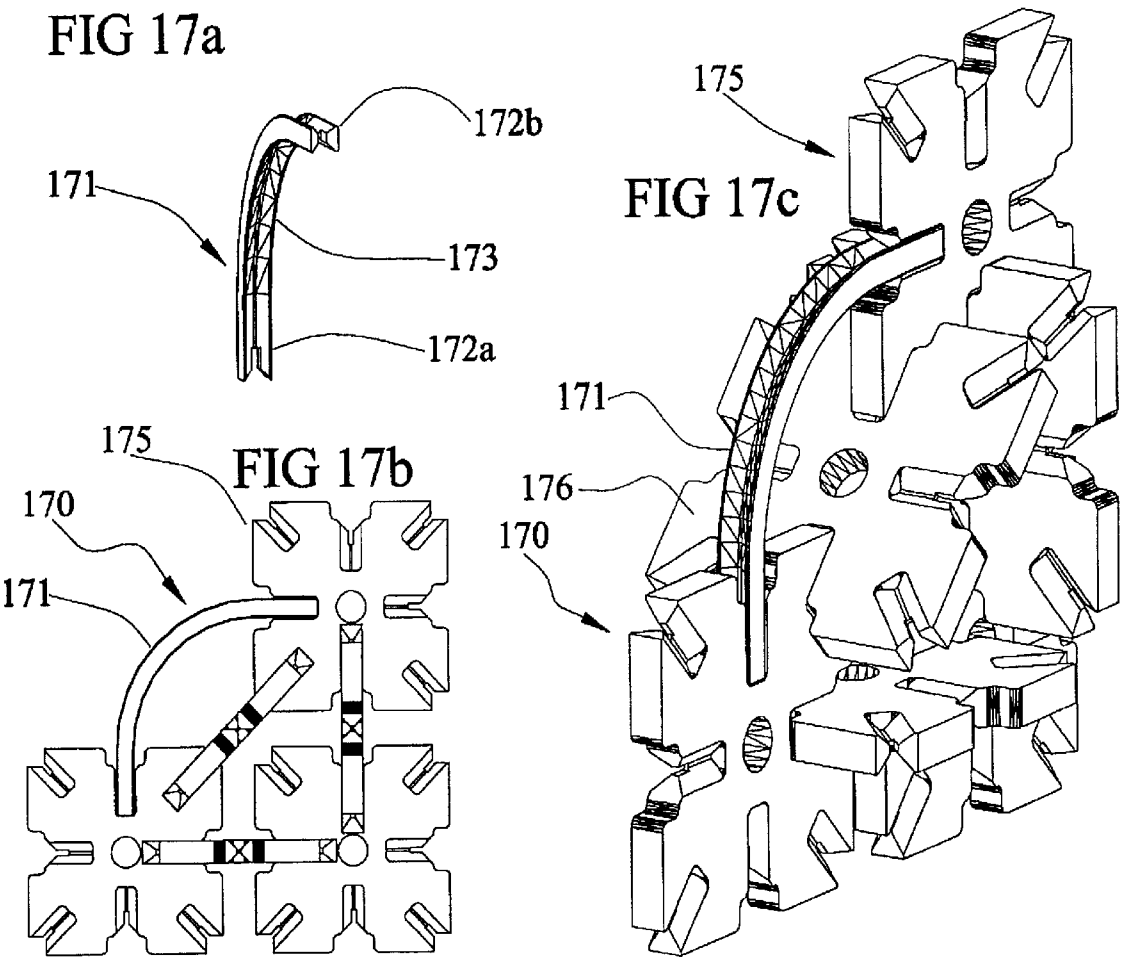
FIGS. 17*a*, 17*b*, and 17*c* show in plan, end and perspective views a curved rod. It acts as a curved hypotenuse to complete a 1-1-square-root-of-two right triangle by connecting to the hub connectors one beyond where a straight rod would connect.

In FIG. 17 we show a curved rod that acts as a curved hypotenuse to complete a 1-1-square-root-of-two right triangle by connecting to the hub connectors one beyond where a straight rod would connect.

Figures 18A, 18B, 18C, 18D:
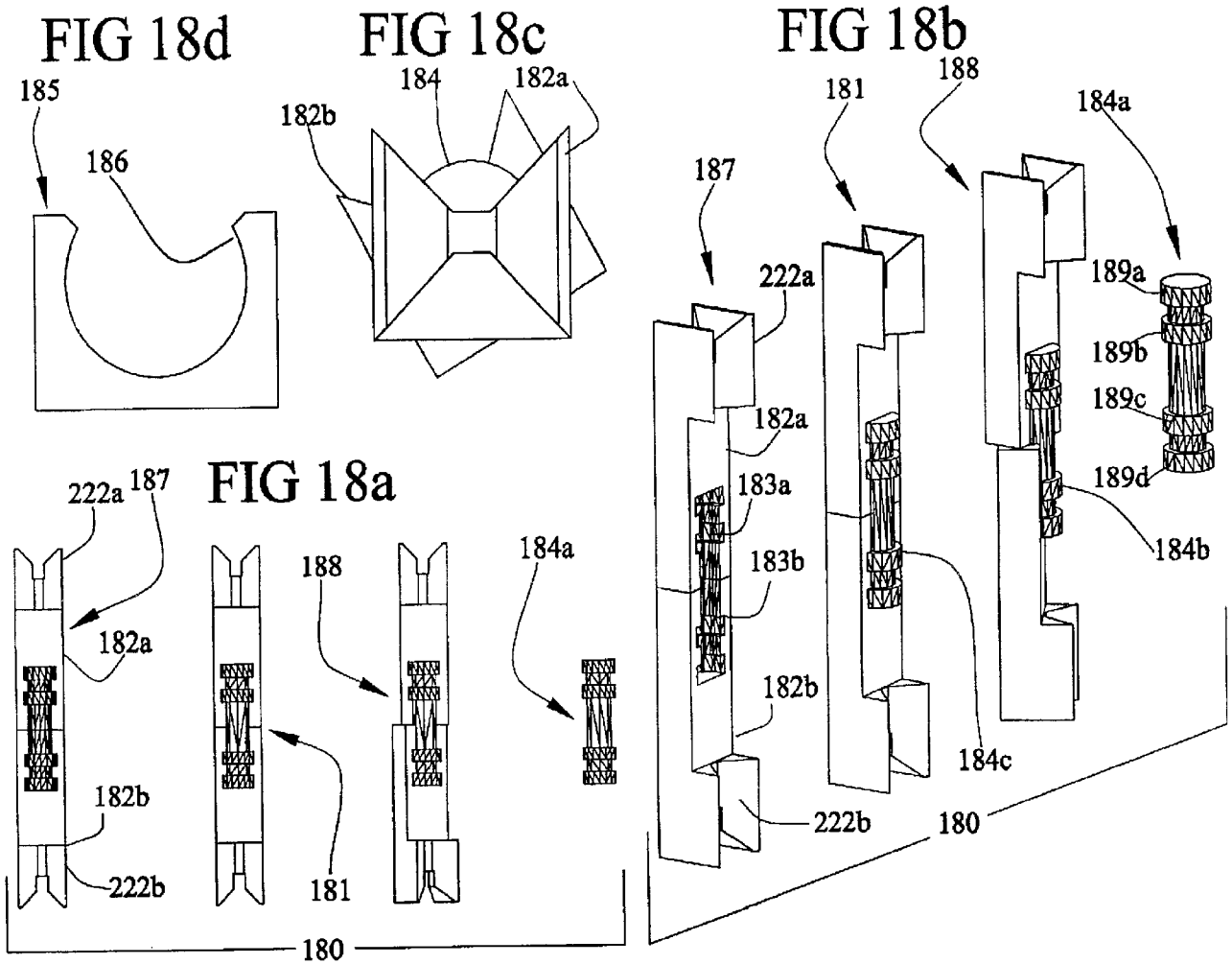
FIGS. 18*a*, 18*b*, 18*c*, and 18*d* show in plan, end and perspective views a rod capable of swiveling about its long axis being comprised of two identical parts and an axle with the axle press-fit into a bearing cavity.

In FIG. 18 we show a rod that can swivel about its long axis. It is composed of two identical parts and an axle-bearing press-fit into an axle-bearing cavity. Said rod can be used as an axle.

DETAILED OF THE FIGURES

An embodiment of the invention 11 in FIG. 1 is a totipotent hub. Said hub is furnished with eight genderless connectors 13*a* to 13*g* whose properties are fully disclosed in the related patents. 11 is similar to the hubs of the related patents with eight connectors radially arrayed at equal 45 degree angles around its center except that instead of being round it is square with four connectors at the corners and four in the middle of the straight sides. Said hub has a center hole 12 in the center of body 16. The four orthogonal connectors have cutouts 15*a* to 15*d* to accommodate the correct connection distance. A typical connector 13*c* is furnished with a backstop 14 and a web face 17. In FIG. 2 we show an embodiment of the invention 21 identical to 11 with relative dimensions shown. The distance from orthogonal west connector's web face 22*a* to orthogonal east connector's web face 22*b* is α. The distance from corner NW. connector's web face 23*a* to corner SE connector's web face 23*b* is β. The orthogonal distance d from points 24*a* to 24*b* give the orthogonal size of 21's body. And the orthogonal distance from N web face 25*b* to nearest body side 25*a* is w. As above $\beta=\alpha((2\sqrt{2})-1)$.

An assembly 51 of nineteen identical totipotent hubs of the invention is shown in FIG. 5. Nine hubs 52*a* . . . 52*i* are assembled in a flat plane in a 3×3 square array. Said hubs are connected by hubs 52*j* . . . 52*q* orthogonal to the plane and arranged in a square. Hubs 52*r* and 52*s* are also orthogonally oriented to the plane but connect the center hub 52*e* diagonally.

Figure 6B:
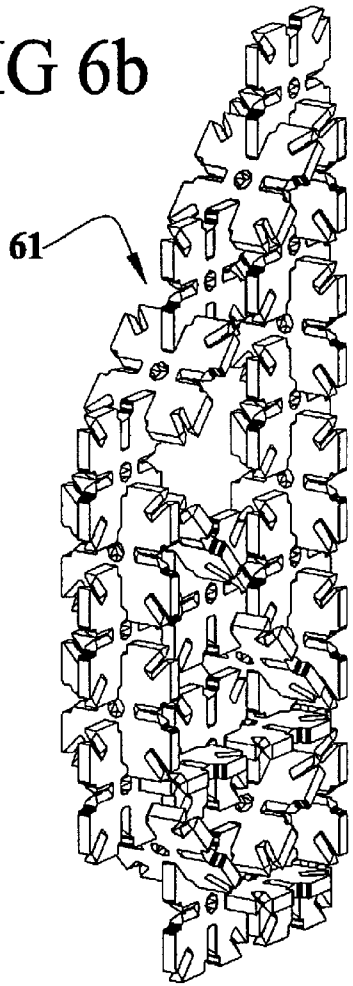
FIGS. 6*a* and 6*b* show identical totipotent hubs assembled into a logarithmic spiral in both plane and perspective views.
Figure 6A:
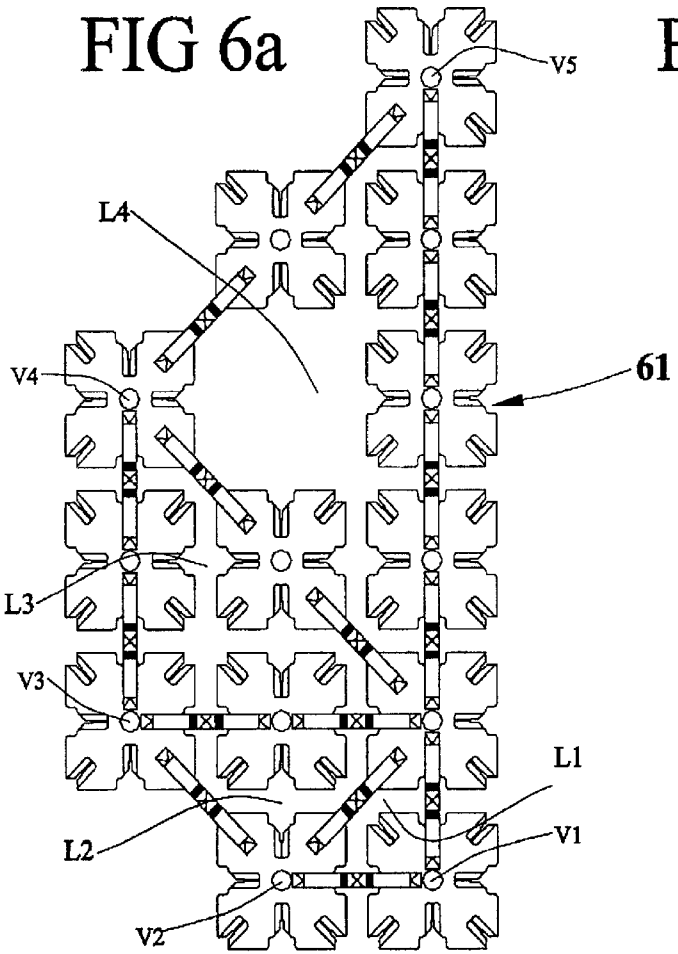
Figures 7A, 7B, 7C:
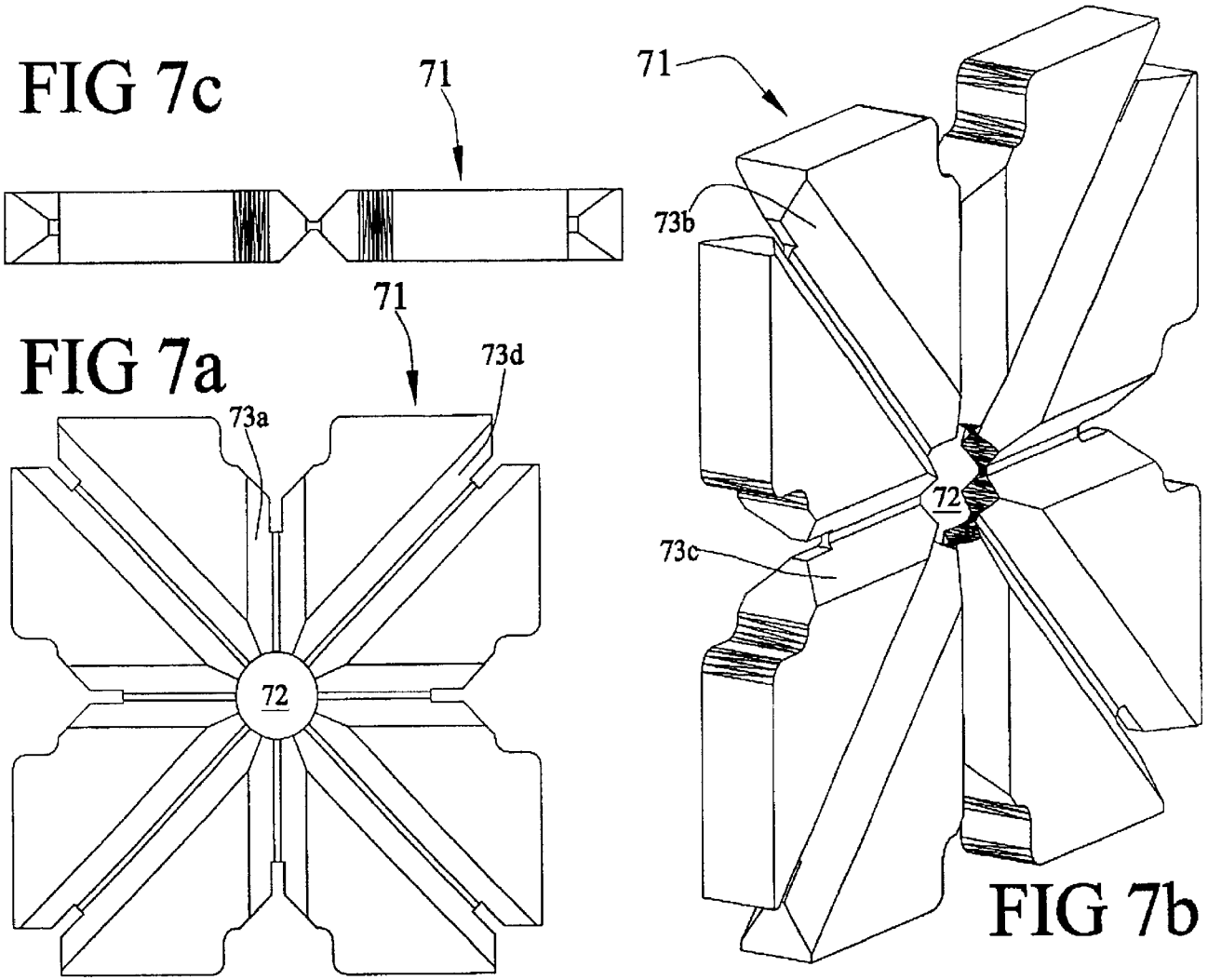
FIGS. 7*a*, 7*b*, and 7*c* show a totipotent hub none of whose genderless connectors have backstops.

FIGS. 6*a* and 6*b* show an assembly 61 similar to assembly 51 but instead twenty-nine identical hubs of the invention are arranged in a logarithmic spiral. The center points v1 . . . v5 of five of the hubs are the first five vertices of a logarithmic spiral created by included triangles L1 . . . L5.

In FIG. 7 we have an embodiment 71 similar to 11 but none of its eight connectors 73*a* to 73*h* have backstops. Said hub is furnished with an optional center hole 72.

Figures 8A, 8B, 8C:
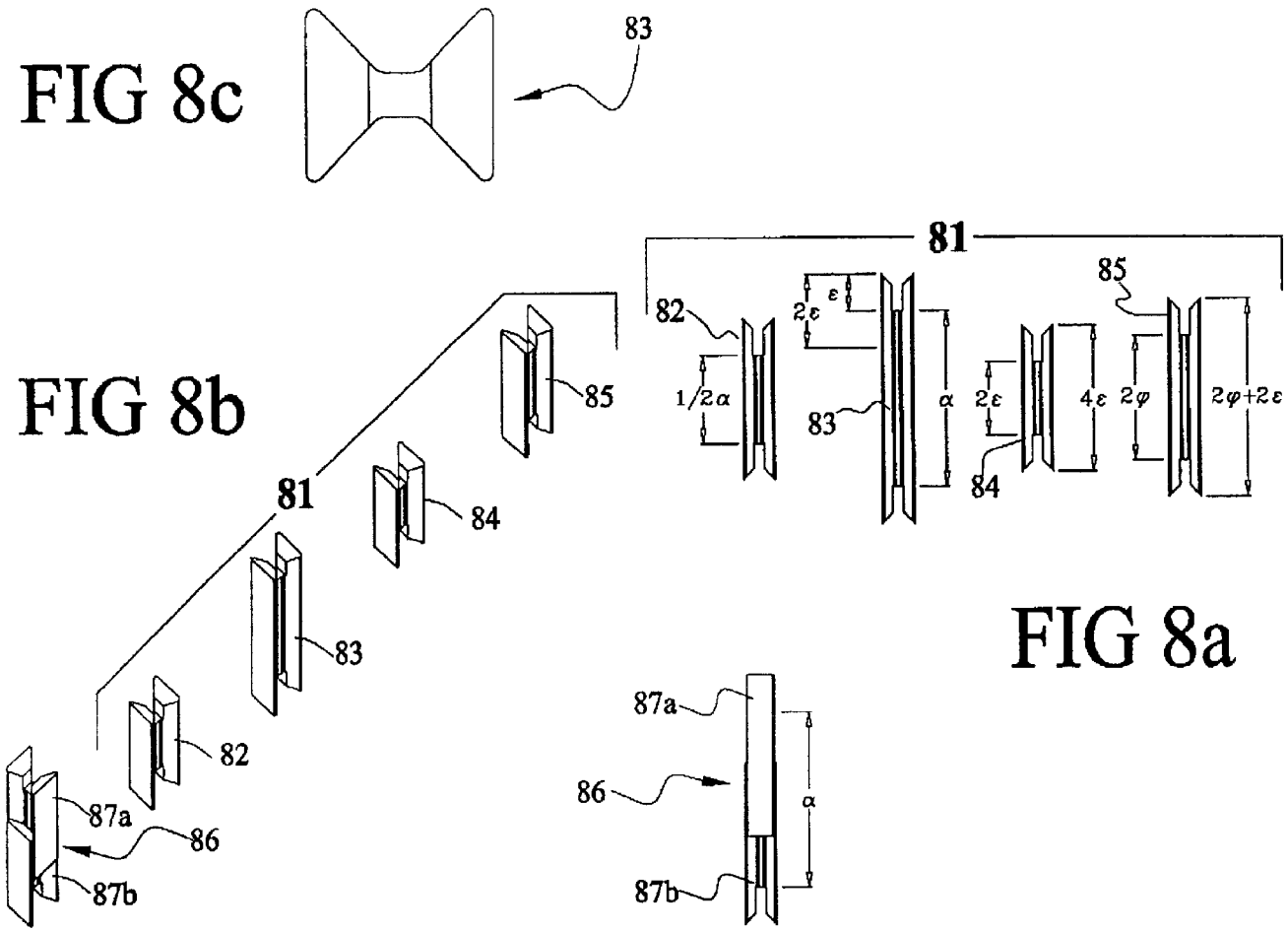
FIGS. 8*a*, 8*b*, and 8*c* show in plan, end and perspective views various rods that could be used with the totipotent hubs.

The connection length of a rod of the inventions is given by its web face to web face distance. In FIG. 8 we have rods whose connectors have no backstops and whose connection distances are useful with embodiment 11 and with hubs, rods, etc. of the related applications. Rod 82 has a connection length of ½α. Two such rods 87*a* and 87*b* are shown assembled into an assembly 86 that is effectively an α-length rod with free end connectors whose planes of connection are at right angles. Rod 85 has a connection length of 2*w*. With said rod two hubs similar to 11 can be assembled such that their edges touch. Rod 83 is a simple α-length rod similar to other rods in the related applications but without backstop. With all of these rods the orthogonal distance from web face to nearest tip is e, which is ½ the standard connector length. Rod 84 has a connection length of 2*e* and can be used to connect almost any two similarly scaled elements of this or any of the related applications such that their edges touch.

Figures 9A, 9B, 9C:
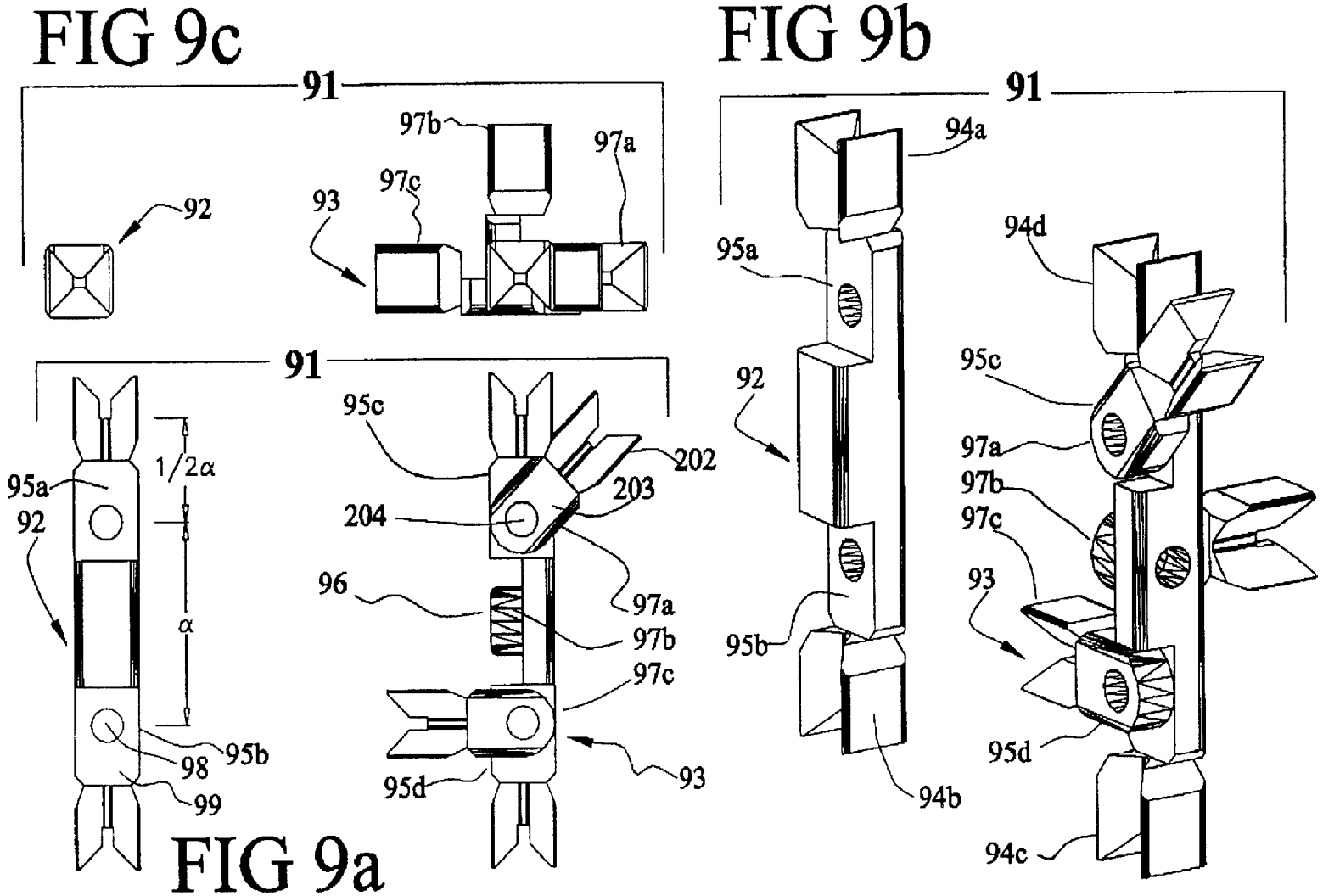
FIGS. 9*a*, 9*b*, and 9*c* show in plan, end and perspective views two beams—A and B.
Figures 11A, 11B, 11C, 12:
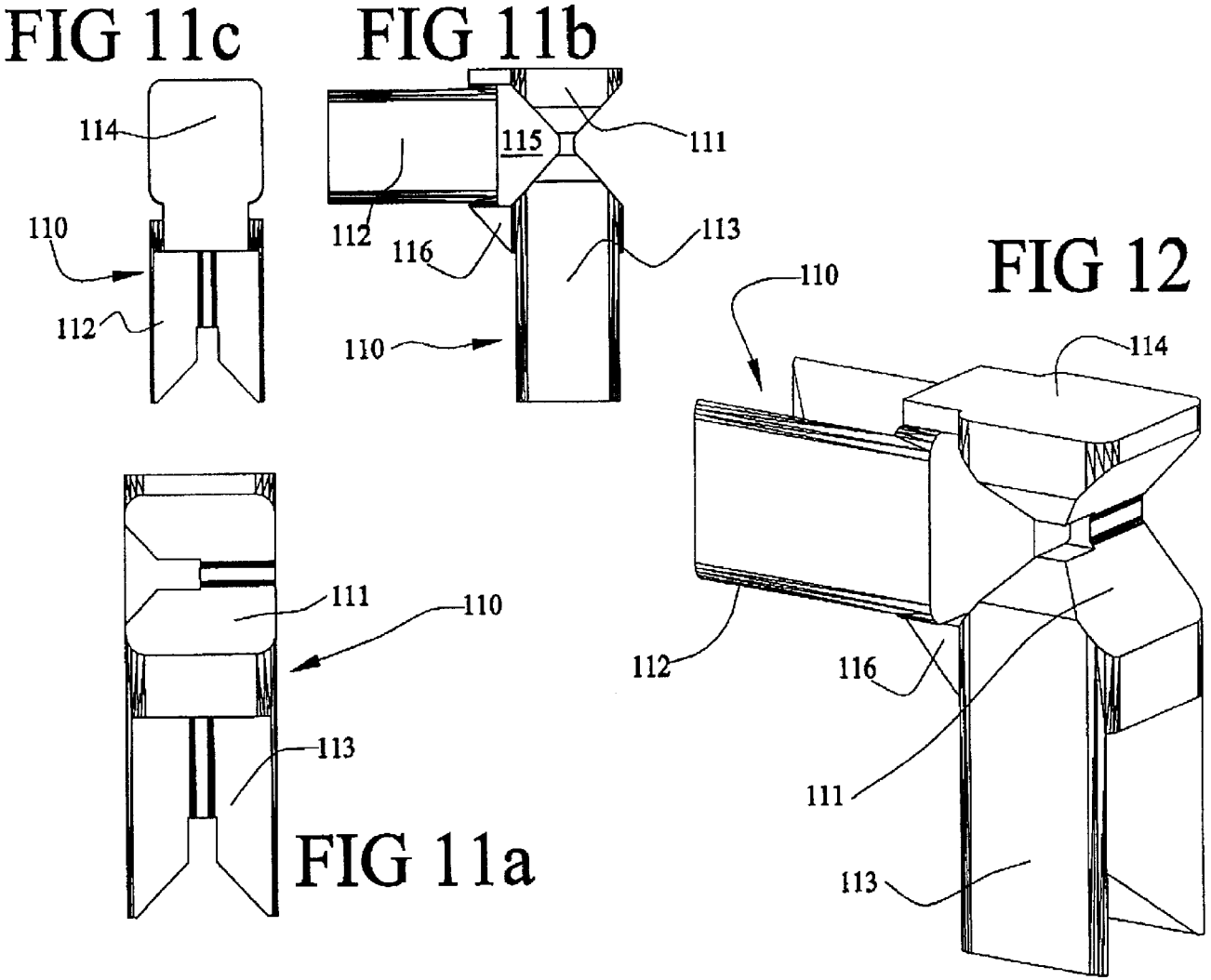
FIGS. 11*a*, 11*b*, 11*c*, and 12 show in plan, end, and perspective views a corner connector, two of the connectors being in the same plane but at right angles to each other while the plane of the middle connector is at right angles to the other two.

Embodiments of the inventions shown in FIG. 9 and FIG. 10 are beams to be used as construction elements in frame-based construction systems. 91 are two similar beams 92 and 93. Beam 92 is shown with end connectors 94*a* and 94*b*. It is also furnished with two locations 95*a* and 95*b* to which swivel connectors similar to 97*a* can be attached. Such a location consists of a medially located through hole 98 and an area with material removed 99 such that the material thickness of the beam is ½ its full thickness as shown at location 95*b*. This thickness relationship is shown clearly in the plan view of swivel connection 96. Also the area of removal must be great enough to allow the swivel connector room to rotate. Swivel connectors 97*a* . . . 97*c* on beam 93 located at swivel connection locations 95*c*, 95*d* and 96 themselves consist of full-sized genderless connectors 202 connected to a ½-thickness body 203 containing a rivet hole 204 as shown on swivel connector 97*a*. Beam 93 is also furnished with end connectors 94*d* and 94*c*. As shown, beams 92 and 93 are 2α long and are also α-spaced with swivel connection rivet holes centered ½α or α from the nearest web face. Note that the plane of connection at connection location 96 is at right angles to the plane of all the other connectors and connector locations (except for its attached swivel connector 97*b*).

101 of FIG. 10 are three α-length beams 102 is a simple beam whereas 103 and 104 can be used to make T-connections. Connectors 105*a* . . . 105*f* are normal connectors whose planes of connection are all in the same plane. On beam 103, connector 106's plane of connection is in the same plane as the other two connectors 105*c* and 105*d* on 103 but its angle of admittance is at right angles to 105*c* and 105*d,* which orientation allows a T-joint to be realized. Whereas, the plane of connection for connector 107 on beam 104 is at right angles to the planes of connection for connectors 105*e* and 105*f.* Such an orientation also allows a T-joint to be realized.

A three-connector-corner connector 110 of FIG. 11 can be realized as beam 104 cut and welded back together such that connectors 105*e* and 105*f* (112 and 113 in 110 respectively) are still in the same plane but 105*e*'s angle of admittance is now at right angles to that of 105*f.* Connector 111 corresponds to connector 107. 114 and 116 are needed to attach 112 to the rest of the assembly. Gap 115 must be there to allow a connection at connector 111.

Figures 13A, 13B, 13C, 13D:
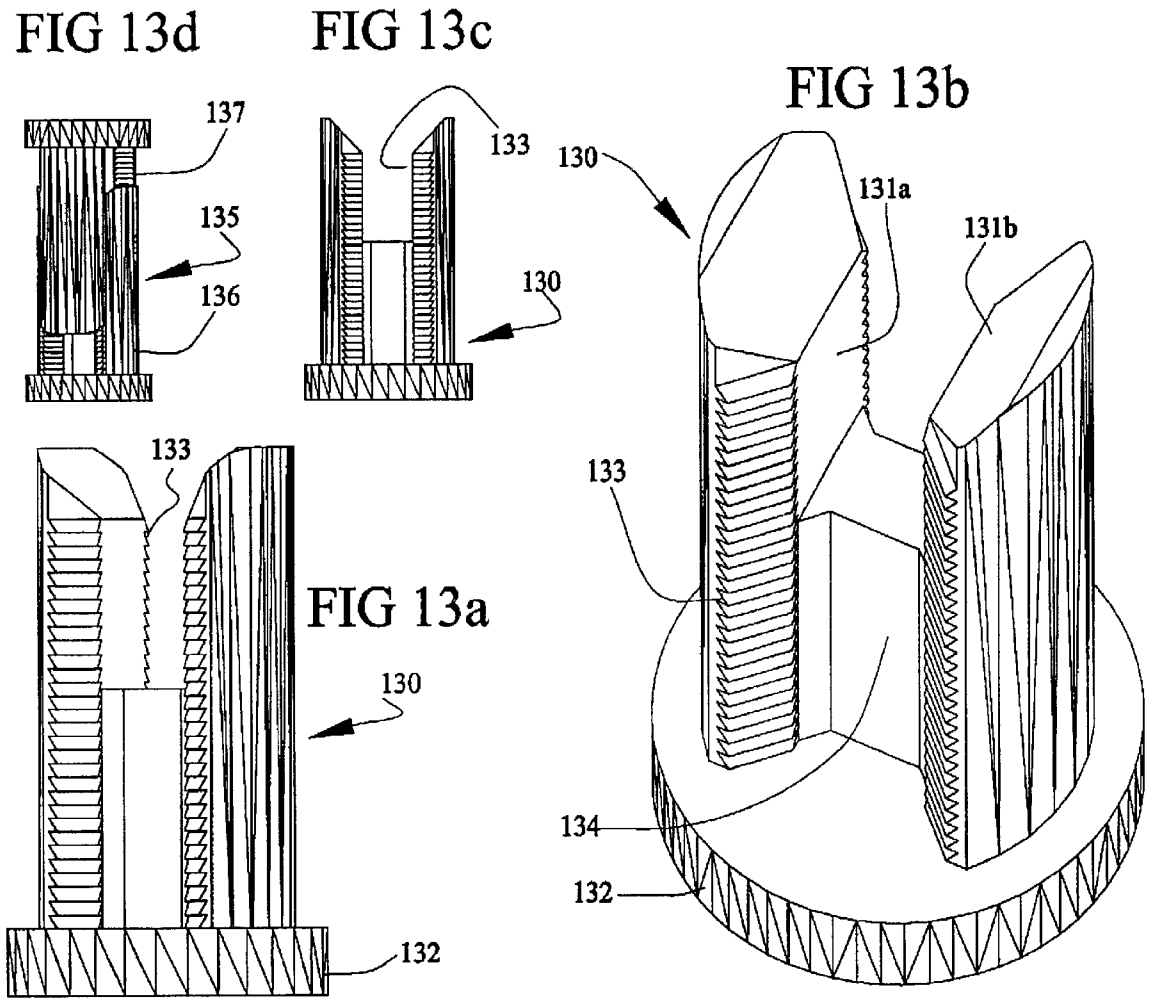
FIGS. 13*a*, 13*b*, 13*c*, and 13*d* show in semi-plan and perspective views a genderless demi-rivet; two such demi-rivets, when connected to each other, form a rivet and do not require a well-defined rivet hole, the mating surfaces of the demi-rivets being furnished with 'one-way' grooves.
Figure 14C:
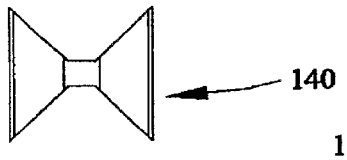
FIGS. 14*a*, 14*b*, 14*c*, and 14*d* show in plan, end and perspective views one half of an adjustable length rod(/beam). When two such are mated together at their adjustable length ends they form an adjustable length rod(/beam). The adjustable length mating surfaces are rough—similar to the mating surfaces of the demi-rivets but not as extreme.
Figure 14A:
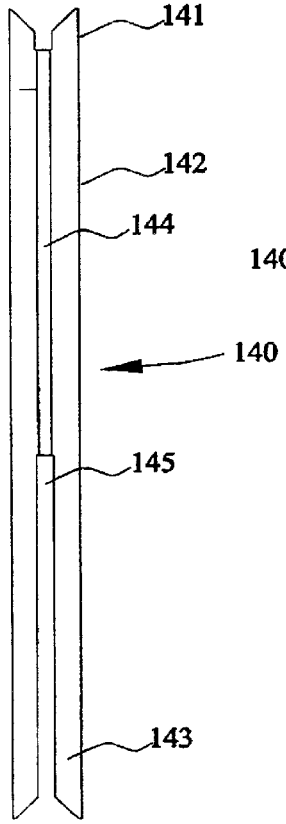
Figure 14B:
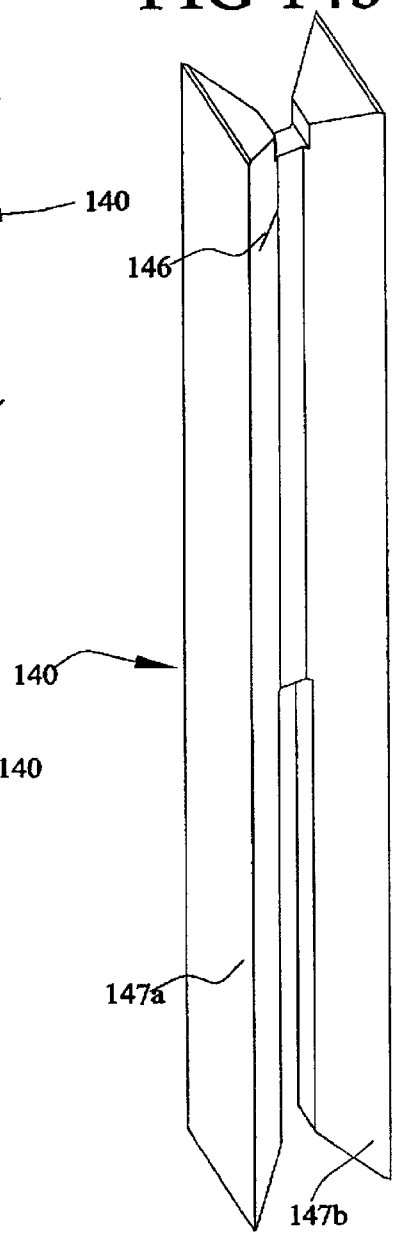
Figure 14D:
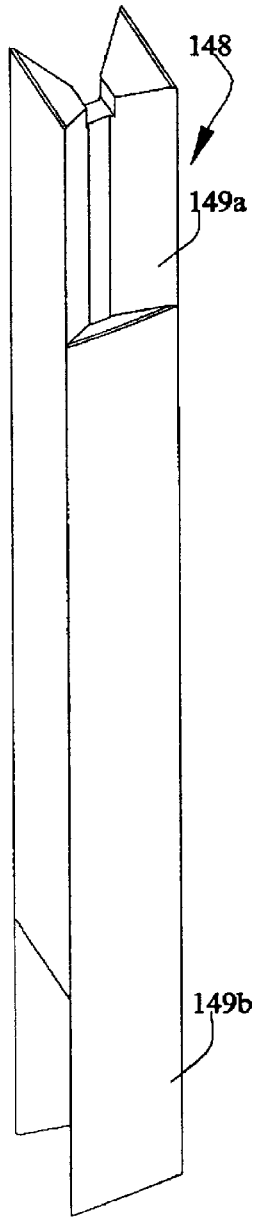

Genderless demi-rivet 130 of FIG. 13 is similar to the rods disclosed in this and related applications except that in place of a rod-body it is furnished with a rivet head 132. Web 134, half the length of connector fingers 131*a* and 131*b* reinforces them. One-way groove strips 133 placed on each 458 face of said connector fingers keep two demi-rivets 136 and 137 firmly attached to each other after connection as shown in assembly 135. In rivet 135 demi-rivets 136 and 137 are shown not fully joined. Even so, with one-way grooves 133 and sufficient interference fit it could be extremely difficult to separate them.

Demi-adjustable-length rod 140 of FIG. 14 consists of a regular connector 141 on one end and a longer connector 142 on the other on the end. Line 146 marks the operational division between said connectors. As shown web 144 runs through both connectors and its total length is ½ the length of said regular connector plus ½ the length of said long connector. Gap 145 is ½ the length of 142. Two-way groove strips 143 decorate the 458 faces of connector fingers 147*a* and 147*b.* Two such demi-adjustable-length rods 149*a* and 149*b,* shown when connected by their long connectors, form an adjustable-length rod 148. Said two-way groove strips hold the said adjustable-length rod at whatever connection position it is placed as long as it remains under no load or a light load. Loading capability will depend on strength of material of the rod, the degree of interference fit and the exact nature of said groove strips.

Hollow construction panel 151 consists of a frame 153 decorated on all four sides with genderless connector strips 152*a* to 152*d,* as shown in FIG. 15. Said connector strips are radially orthogonally arrayed around the frame with connectors facing out. As designed 151 is square so as to impose no orientation when assembled with other construction panels with identical connector configurations. Hollow 154 is optional.

Construction panel 161 is furnished with four genderless connectors 162*a* . . . 162*d* one per side. Similarly for another four genderless connectors 163*a* . . . 163*d.* The only difference between these sets of connectors are there orientation. As you traverse the edge of 161 you must alternate among the 162*s* and 163*s* as shown in FIG. 16. 161 is shown with a solid body 164 and grooves in the connector area 165 which are there to ease connection. Curved rod 171 shown in assembly 170 assembled to an assembly of totipotent hubs 175 has a body 172 furnished with genderless connectors 172*a* and 172*b* on each end. 171 acts as a curved hypotenuse to complete a 1-1-square-root-of-two right triangle by connecting to the hub connectors one beyond where a straight rod or hub would connect. Hub 176 is located in the regular hypotenuse connection position.

In 180 we have three similar axle-swivel rods in three different states. Axle-swivel rod 187 consists of two identical ends 182*a* and 182*b* each furnished with genderless connectors 222*a* and 222*b* at their ends. As shown 187 is in position to have its axle-bearing 184*a* press fit into axle-bearing cavities 183*a* and 183*b*. 184*a* is furnished with four normally positioned bearings 189*a* to 189*d,* two at each end. Axle-swivel rod 181 is shown with axle-bearing assembly 184*c* press fit in. Axle-swivel rod 188 is shown swiveled about its axle 184*b*. Axle-bearing cavity cross section 185 shows a reverse curvature 186 that provides the material interference needed to hold axle-bearings in their cavities after they are press fit in.

The present invention may be embodied in other specific forms without departing from the spirit or essential attributes thereof and accordingly, reference should be made to the appended claims rather than to the foregoing specification as indicating the scope of the invention.

I claim:

1. A construction toy system comprising a plurality of hubs, each of which is capable of functioning both as a hub and as a rod:

each of said hubs being comprised of a substantially flat disc-shaped member lying substantially within a single first plane and including an outer periphery defining the outer extent of said disc-shaped member within said first plane;

each of said hubs being substantially in the shape of a square with four sides and four corners;

each of said hubs including eight substantially identical genderless connectors located substantially equally spaced around the outer periphery of said disc-shaped member and facing outwardly from the same substantially in said first plane, said genderless connectors being located at each of said corners and on each of said sides, the connectors located on said sides being recessed inwardly.

2. A construction toy system as set forth in claim 1 wherein each of said hubs has an upper surface and a lower surface which are substantially identical to each other whereby there is no up or down orientation to said hubs.

* * * * *